US009951286B2

(12) United States Patent
Mitchell

(10) Patent No.: US 9,951,286 B2
(45) Date of Patent: Apr. 24, 2018

(54) MATERIAL CONSISTING OF A PREPARATION COMPRISING FERROCENE

(71) Applicants: UNIVERSITE DE RENNES 1, Rennes (FR); CENTRE NATIONAL DE LA RECHERCHE SCIENTIFIQUE—CNRS, Paris (FR)

(72) Inventor: James Brian Mitchell, Rennes (FR)

(73) Assignee: CENTRE NATIONAL DE LA RECHERCHE SCIENTIFIQUE—CNRS, Paris (FR)

( * ) Notice: Subject to any disclaimer, the term of this patent is extended or adjusted under 35 U.S.C. 154(b) by 0 days.

(21) Appl. No.: 15/304,760

(22) PCT Filed: Apr. 17, 2015

(86) PCT No.: PCT/EP2015/058459

§ 371 (c)(1),
(2) Date: Oct. 17, 2016

(87) PCT Pub. No.: WO2015/158922

PCT Pub. Date: Oct. 22, 2015

(65) Prior Publication Data

US 2017/0037335 A1 Feb. 9, 2017

(30) Foreign Application Priority Data

Apr. 17, 2014 (FR) ..... 14 00923

(51) Int. Cl.

| | |
|---|---|
| ***C10L 10/00*** | (2006.01) |
| ***C10L 10/02*** | (2006.01) |
| ***C10L 1/10*** | (2006.01) |
| ***C10L 1/30*** | (2006.01) |
| ***C10L 9/10*** | (2006.01) |
| ***A62D 1/00*** | (2006.01) |
| ***C10L 1/12*** | (2006.01) |

(52) U.S. Cl.

CPC ..... *C10L 10/02* (2013.01); *A62D 1/0014* (2013.01); *C10L 1/10* (2013.01); *C10L 1/1233* (2013.01); *C10L 1/305* (2013.01); *C10L 9/10* (2013.01); *C10L 1/1275* (2013.01); *C10L 1/1291* (2013.01); *C10L 2250/06* (2013.01)

(58) Field of Classification Search

CPC ..... C10L 10/02; C10L 1/10; C10L 1/1275; C10L 1/1291; C10L 1/305; C10L 9/10; C10L 1/1233; C10L 2250/06; A62D 1/0014

See application file for complete search history.

(56) References Cited

U.S. PATENT DOCUMENTS

| | | | | |
|---|---|---|---|---|
| 607,292 | A * | 7/1898 | Stocker | C04B 28/26 106/620 |
| 4,197,913 | A | 4/1980 | Korenowski | |
| 5,713,964 | A | 2/1998 | Schreiner et al. | |

FOREIGN PATENT DOCUMENTS

| | | | |
|---|---|---|---|
| CN | 1695752 | * | 11/2005 |
| DE | 3729930 | A1 | 3/1989 |
| FR | 2602977 | A1 | 2/1988 |
| FR | 2935907 | A1 | 3/2010 |
| WO | 2004014489 | A1 | 2/2004 |
| WO | 2013032447 | A1 | 3/2013 |

OTHER PUBLICATIONS

Database WPI Week 200934, Thomson Scientific, 2009, pp. 1-3, XP002734008.

International Search Report dated Jul. 16, 2015 re: Application No. PCT/EP2015/058459; pp. 1-3; citing: WO 2013/032447 A1, Database WPI, DE 37 29 930 A1, FR 2 602 977 A, FR 2 935 907 A1 and US 4 197 913 A.

* cited by examiner

*Primary Examiner* — Cephia D Toomer
(74) *Attorney, Agent, or Firm* — Cantor Colburn LLP

(57) ABSTRACT

The invention relates to a material consisting of a preparation made from a mixture of ferrocene and an inert flameproof material such as plaster, the material being presented in the form of granules and being suitable for spreading over a hydrocarbon fire in a simple and rapid manner such that, under the effect of the heat from the fire, the ferrocene contained in the granulated material is diffused progressively and homogeneously in a vapor phase over the base of the flames, so as to optimize the combustion of the hydrocarbon and to reduce the emission of smoke and unwanted particles.

4 Claims, 2 Drawing Sheets

MATERIAL CONSISTING OF A PREPARATION COMPRISING FERROCENE

FIELD OF THE INVENTION

The invention relates to the field of the combustion of hydrocarbons. More particularly, the invention relates to the reduction of smoke coming from the combustion of hydrocarbons and the reduction of unwanted combustion products.

PRIOR ART

In the case of poor combustion of a hydrocarbon and when there is sufficient oxygen to guarantee complete combustion, the product of the combustion is broken down into carbon dioxide and water, in proportions established according to the following transformation equation:

$$2C_xH_y+(2x+0.5y)O2\rightarrow 2xCO_2+yH_2O$$

In the context of a rich combustion of a hydrocarbon and when the oxygen content is insufficiently present to guarantee complete combustion, an emission of residual materials and of combustion gasses is observed, such as, for example, soot and other particles, in gaseous or aerosol form, usually called "productions of incomplete combustion" ("PICs"). The smoke resulting from the incomplete combustion of hydrocarbons include many chemical compounds, such as, for example, polycyclic and aromatic hydrocarbons (PAH), volatile organic compounds (VOC), non-burnt fuels and other derivatives of combustion products in addition to solid particles commonly referred to as soot and which contain carbon as well as possibly oxygen and hydrogen, in addition to the impurities present in the combustibles before combustion. Some of these elements are harmful to the health of persons. It is then important to be able to limit the emission thereof.

In controlled contexts, such as an oven or any other similar device adapted to controlled combustion, it is possible to limit the unwanted and/or harmful combustion compounds by supplying, for example, oxygen to the flames either by mixing beforehand oxygen with the fuel, or by distributing air in the flames.

In contexts where the adding of oxygen is uncontrollable or is poorly controlled, there is an emission of PICs into the atmosphere, most often accompanied by the presence of a range of visible smoke. Regulations relating to combustions that are able to generate PICs often aimed at limiting the opacity of the smoke and retaining good visibility through the combustion products, and this, whether or not the combustions are operating in a free atmosphere or in a structure provided with a chimney or with a smoke exhaust device.

Fuel or crude oil fires lead to emissions of smoke that are particularly dense. This sometimes occurs accidentally during oil spillage operations or during firefighting exercises.

Fires of automobile tyre stocks can burn for very long periods of time and release enormous quantities of smoke, in particular due to the fact of the presence of air in such a stack.

Fires of clusters of waste, household or other, have characteristics in terms of duration and pollution.

These situations are such that they cause substantial damage to the environment, which include physical and visual pollution.

Indeed, the emission of thick smoke results in a negative perception of the public with regards to the operations at the origin of the emanations or incidents related to these emanations.

U.S. Pat. No. 5,713,964 (Mitchell, 1991) discloses that a mixture of ferrocene and of hydrocarbon substantially reduces the emissions of smoke, PAH and VOC, during a combustion in the free atmosphere and when the mixture was carried out prior to combustion. Ferrocene, also called iron dicyclopentadienyl, is an organometallic compound with formula $Fe(C_5H_5)_2$. It is a member of the metallocene family. Ferrocene itself is a flammable compound and adding it to a fire leads to an emission of red smoke due to the formation of particles of iron oxide.

Patent application WO2004/014489 A1, published on 19 Feb. 2004, discloses a fire extinguishing device, in the form of a plastic ball containing a detonating pyrotechnic system, dispersing dry powders, reagents, liquids or others, individually or in combination.

Although the dispersion of ferrocene on a hydrocarbon fire allows for a substantial reduction in the emissions of unwanted particles, such as described hereinabove, the method of distribution is important and largely conditions the effectiveness of the method. An incorrect propagation of ferrocene on the fire results in limited action. If the ferrocene is spread before the outbreak of the fire, its distribution is not homogeneous and results in limited effectiveness.

A dispersion using a container device similar to that mentioned hereinabove and used for the purposes of extinction, does not optimally respond to homogeneous distribution. The high temperatures quickly damage the capsules acting as containers and the distribution is not controlled.

A direct distribution of the ferrocene on a fire does not also allow for effectiveness, as the latter cannot therefore reach the base of the flames, as it is itself flammable.

The existing solutions have disadvantages.

SUMMARY OF THE INVENTION

The invention makes it possible to improve prior art by proposing a material comprising a preparation made from a homogeneous mixture of an organometallic compound and of an inert flameproof material.

According to an embodiment of the invention, the organometallic compound is ferrocene. According to an alternative, the organometallic compound is a derivative of ferrocene.

According to an embodiment of the invention, the inert flameproof material is a porous material.

Advantageously, the inert flameproof material is plaster or fireclay.

Here, "homogenous mixture" means a mixture wherein each of the components is present in substantially identical proportions over the entire preparation.

According to an embodiment of the invention, the quantity of ferrocene or of the derivative of ferrocene represents a rate of 10 to 30% of the total material that comprises the granule.

According to an embodiment of the invention, the material has the form of a granule comprised of the aforementioned material.

Advantageously, the granule of material is hollow and its density is such that it can float on the surface of an oil or of a liquid hydrocarbon.

According to an embodiment of the invention, the granule of material has a spherical, elliptical, rectangular, square shape, or the shape of a chip.

Advantageously, the largest dimension (or the overall size) of the granule of material does not exceed 30 millimeters (typically from 10 to 30 mm).

According to an embodiment of the invention, the granule of material is able to progressively release the particles of ferrocene in the form of vapour and under the effect of the heat when it is positioned on the surface of a hydrocarbon fire.

According to an embodiment of the invention, the granule of material is adapted in particular to a progressive releasing of the particles of ferrocene, in vapour phase, in the form of ferrocene vapour, due to the progressive degradation of the inert flameproof material under the effect of the heat emitted by the hydrocarbon fire.

LIST OF FIGURES

The invention shall be better understood, and other particularities and advantages shall appear when reading the following description, with the description referring to the annexed drawings among which:

Figure 3:
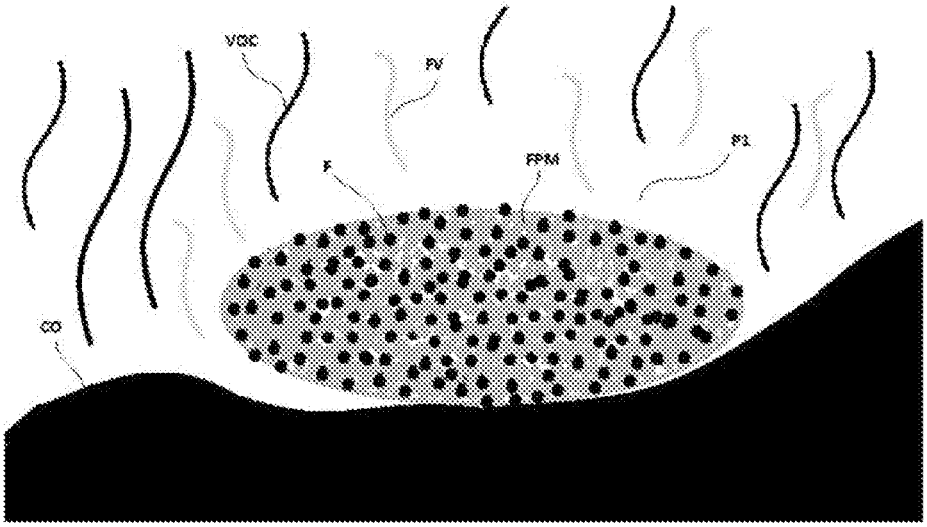

FIG. 3 a granule of material comprising ferrocene and plaster according to a particular and non-limiting embodiment of the invention, on the surface of a hydrocarbon compound on fire.

Figure 4:
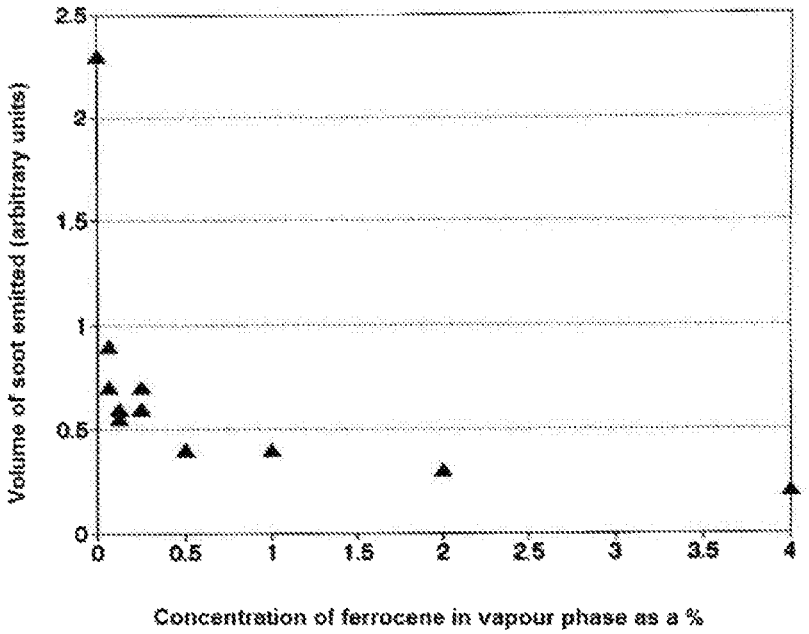

FIG. 4 is a graph representing the emission values of soot coming from a hydrocarbon fire according to the rate of ferrocene present in vapour phase according to a particular and non-limiting embodiment of the invention.

DETAILED DESCRIPTION OF EMBODIMENTS OF THE INVENTION

Figure 1:
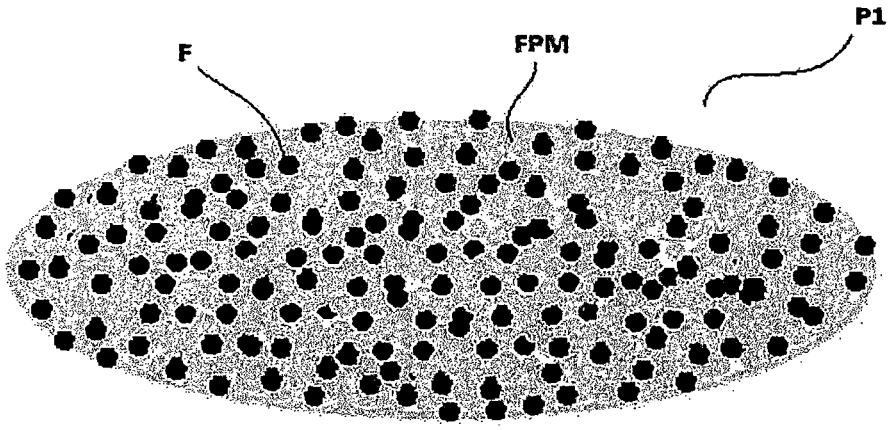
FIG. 1 shows a granule of material comprised of ferrocene and plaster according to a particular and non-limiting embodiment of the invention.
Figure 2:
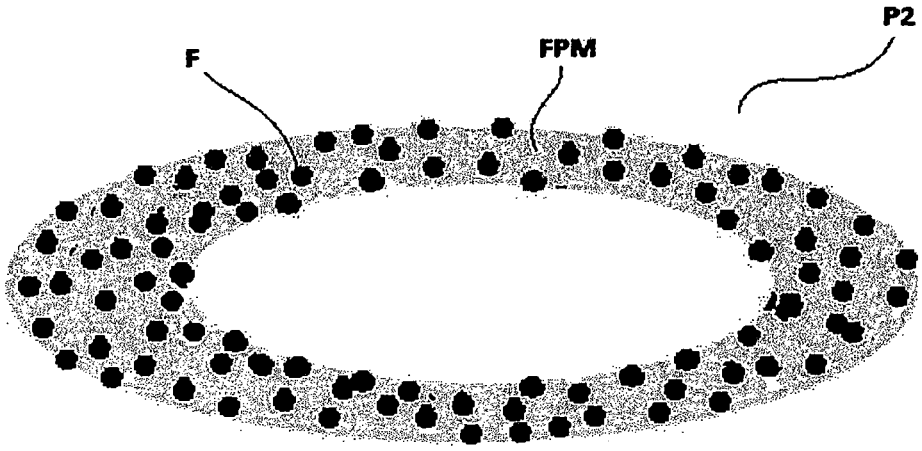
FIG. 2 shows a cross-section view of a granule of material similar to the one shown in FIG. 1, but of hollow shape, according to a particular and non-limiting embodiment of the invention.

In FIGS. 1 to 3, the modules shown are functional units, which correspond or which do not correspond to physically distinguishable units. For example, these modules or some of them are grouped together in a single component. On the contrary, according to other embodiments, some modules are comprised of separated physical entities.

FIG. 1 shows a granule P1 of material constituted of a preparation made from a mixture of particles F of ferrocene (Iron dicyclopentadienyl; $Fe(C_5H_5)_2$) and/or of particles F of a derivative of ferrocene and of a matrix of inert flameproof material FPM according to a particular and non-limiting embodiment of the invention.

According to the preferred embodiment of the invention, the inert flameproof material FPM matrix of the material is constituted of plaster (also called "Plaster of Paris or hydrated calcium sulphate).

Advantageously, the use of material in the form of granules constituted as such allows for a homogeneous spreading (a distribution) of ferrocene at the base of the flames of a hydrocarbon fire, with the aim to improve the combustion and to substantially reduce the emanations of unwanted particles and/or compounds.

Indeed, ferrocene is a crystalline compound that evaporates starting at 100° C. Its melting temperature is 174° C. and its boiling temperature is 249° C. when the vapour pressure is equal to atmospheric pressure, under standard atmospheric conditions. It is furthermore a flammable substance in air of which the combustion leads to the appearance of particles of iron oxide. Ferrocene is very stable a high temperatures ranging up to 500° C.

The heavy oils, mixing various hydrocarbon compounds, such as aliphatic or aromatic compounds, for example, are characterised by boiling temperatures between 50° C. and 400° C.

Ferrocene present on the surface of a hydrocarbon on fire can therefore evaporate from the surface and join the zone of the flames, in vapour phase, in order to act as a catalyst for the combustion. Other less stable compounds, such as for example pentacarbonyl $Fe(CO)_5$, cannot evaporate towards the zone of flames but would be confounded, in the form of iron oxide or solid iron, with the hydrocarbons via pyrolysis.

Advantageously, and according to the preferred embodiment of the invention, the conditioning of the ferrocene in granules P1 constituted of a preparation made from a homogeneous mixture of particles F of ferrocene and of flameproof plaster FPM, allows for a homogeneous distribution in the zone of the fire and an increased efficacy as a combustion catalyst. The entry of the ferrocene according to the method of conditioning as granules protects it from the high temperatures of the zone of flames, ranging beyond 1000° C., during the spreading phase. The progressive increase in the temperature of the porous granules, under the effect of the fire, then releases the ferrocene, in vapour phase, on the surface of the hydrocarbon on fire, where the temperature is less than 500° C.

The distribution of the ferrocene according to the embodiment of the invention is therefore progressive and slow, which allow for efficacy of the method. The ferrocene is progressively released from the granules, in the form of vapour. The ferrocene vapours released as such mix with the vapours of the hydrocarbons on fire. The combustion is in practice a combustion of vapours.

Advantageously, the plaster envelope present in the granules protects the particles of ferrocene from high temperatures during the step of passing through the zone of flames during a spreading operation. The plaster then acting as a thermal insulator prevents an excessively fast rise in the temperature of the particles of ferrocene.

Advantageously, and due to the structure of the granules, the ferrocene can be placed on the surface of a hydrocarbon slick prior to the outbreak of a fire or after the outbreak of a fire.

According to an alternative, the plaster is replaced with fireclay which has similar heat insulating properties.

According to another alternative, the plaster is replaced with zeolite powder.

Advantageously, the structure in granules makes it possible to operate by progressively adding predetermined quantities of ferrocene until a sufficient combustion quality is obtained to reduce the emanation of smoke and or of unwanted particles during a hydrocarbon fire.

According to the preferred embodiment of the invention, the content of ferrocene included in a granule is from 10 to 30% of the total material, as such allowing the granules to not degrade excessively quickly and to sufficiently protect the particles of ferrocene during the distribution phase for the purpose of then operating as a combustion catalyst. Such a proportion of ferrocene in the granules results in an approximate proportion of about 0.5% in the mixture of ferrocene vapours and of hydrocarbons on fire.

According to the preferred embodiment of the invention, the granules P1 are of spherical, elliptical, rectangular, square shape or the shape of a chip, or any other form that allows for an easy spreading while acting as a temporary protective thermal barrier of the particles of ferrocene in order to improve the distribution thereof on the hydrocarbon, acting in such a way that it is as homogeneous as possible.

According to the preferred embodiment of the invention, the granules P1 have a maximum size of 30 mm, offering mechanical characteristics that are adapted to a simple and rapid spreading on a hydrocarbon slick.

Note that the slow distribution of ferrocene vapours implemented by the distribution of the ferrocene mixed with an inert flameproof material, in the form of granules, tablets or pellets, for example, also allows for a substantial reduction in the emanations of smoke and of unwanted particles during a fire of solid materials, such as in particular rubber (non-limiting example).

FIG. 2 shows a granule P2 similar to the granule P1, viewed as a cross section, of which the hollow structure allows it to float (or to float better) on the surface of a liquid hydrocarbon slick.

Advantageously, the hollow portion of the granule P2 comprises air, aiming to reduce its density and to supply oxygen to the combustion.

According to the preferred embodiment of the invention, the granules are manufactured according to methods of manufacturing that are well known to those skilled in the art in the field of manufacturing granules or tablets and implement, for example, a method of pelletising.

For example, and according to a preferred and non-limiting embodiment of the invention, the granules comprising ferrocene are obtained via pelletising, by mixing and by wetting a powder of plaster and of ferrocene. A centrifuge movement inside a drying box produces agglomerates that come together by forming compact granules. Certain characteristics of the granules can be improved or carried out by a direct means of granulation or layer-by-layer granulation, for example.

FIG. 3 shows a granule P1 comprising ferrocene F and a plaster FPM according to a particular and non-limiting embodiment of the invention, at the surface of a hydrocarbon compound CO on fire. A combustion of the hydrocarbon CO generates hydrocarbon combustion VOC vapours. A slow and progressive releasing of ferrocene vapour FV is carried out from the granule P1, under the effect of the heat. The vapours FV then advantageously mix with the vapours OV and operate a combustion catalyst effect, resulting in a substantial decrease of the emanations of smoke and unwanted particles.

Note that, as an indicator of performance, pellets attached to floating elements (plugs), and comprising a mixture of plaster and of ferrocene, carried out according to a particular and non-limiting embodiment of the invention, made possible a reduction from 90 to 95% in the emissions of smoke from a light crude oil fire, in a container of reduced dimensions.

This experiment was conducted in a container 165 centimeters in diameter containing 80 liters of light crude oil with 32 pastilles of a diameter of 27 mm each.

FIG. 4 is a graphical representation showing the rates of emission of soot coming from a hydrocarbon fire according to the content of ferrocene F present in the vapour phase and released due to the increase in temperature of the granules P1 or P2 dispersed on the surface of the fire.

The concentration of ferrocene in the vapour phase is expressed in FIG. 4 as a percentage of the ferrocene vapours FV with respect to all of the vapours present and composed of the sum of the vapours of COV hydrocarbon compound and ferrocene vapours FV.

Of course, the invention is not limited to the forming of plaster and of ferrocene described hereinabove but to any formulation comprising particles of ferrocene or derivative of ferrocene mixed with an inert flameproof matrix operating as a temporary thermal barrier in order to protect the ferrocene during a homogeneous distribution on the surface of a hydrocarbon and then allowing for the release thereof for the purpose of operating as a combustion catalyst and reducing the emanations of smoke and/or of unwanted particles.

The invention claimed is:

1. Granule of material comprising a preparation made from a homogeneous mixture of an organometallic compound and of an inert flameproof material (FPM), wherein said inert flameproof material is plaster or fireclay and said material is porous and its greatest dimension is between 10 and 30 mm, wherein the organometallic compound content is between 10 and 30 percent of the total material present in said preparation.

2. Granule of material as claimed in claim 1, wherein said organometallic compound is a set of particles (F) of ferrocene (F) and/or of a derivative of ferrocene.

3. Granule of material as claimed in claim 1, wherein said granule is hollow and that its density is such that it floats on the surface of an oil or of a hydrocarbon.

4. Granule of material as claimed in claim 1, wherein it has a spherical, elliptical, rectangular, or square shape.

* * * * *